US006010369A

United States Patent [19]

Itabashi et al.

[11] Patent Number: 6,010,369

[45] Date of Patent: Jan. 4, 2000

[54] SMALL SIZE MALE MULTI-CONTACT CONNECTOR AND SMALL SIZE FEMALE MULTI-CONTACT CONNECTOR

[75] Inventors: Akihisa Itabashi, Hoya; Yoshiaki Tamai, Tokyo, both of Japan

[73] Assignee: Citizen Watch Co., Ltd., Tokyo, Japan

[21] Appl. No.: 08/799,413

[22] Filed: Feb. 12, 1997

[30] Foreign Application Priority Data

Feb. 13, 1996 [JP] Japan ..... 8-048425

[51] Int. Cl.[7] ..... H01R 13/04

[52] U.S. Cl. ..... 439/660; 439/930

[58] Field of Search ..... 439/660, 488, 439/350, 357, 496

[56] References Cited

U.S. PATENT DOCUMENTS

| | | | |
|---|---|---|---|
| 3,275,967 | 9/1966 | Hamm | 439/660 X |
| 3,414,869 | 12/1968 | Pascua | 439/660 X |
| 3,980,380 | 9/1976 | Cieniawa et al. | 439/660 X |

FOREIGN PATENT DOCUMENTS

| | | |
|---|---|---|
| 4-163873 | of 1992 | Japan . |
| 4-249082 | of 1992 | Japan . |

OTHER PUBLICATIONS

Catalog of Hirose Electric Co., Ltd., Circular Connectors, HR 10 Series, pp. 50–51, Apr. 1983.

Catalog of JC Electronics Corporation, RF Connectors D Sub Connectors, p. 24, Version 2 (1993).

*Primary Examiner*—Paula Bradley

*Assistant Examiner*—Daniel Wittels

*Attorney, Agent, or Firm*—Finnegan, Henderson, Farabow, Garrett & Dunner, L.L.P.

[57] ABSTRACT

Male and female connectors of an extremely small size, while having a number of connection terminals, are provided. The male connector consists of a cylindrical cable-supporting member, a cylindrical conductive-wire guide member, and a core member for coupling the two with each other. The conductive-wire guide member has partitions and holding sections. The conductive wire of the cable passing through the cable-supporting member is folded on the holding section from outside to inside so that the exposed portion of the conductive wire forms a connection terminal of the male connector. The female connector consists of a casing having an insertion hole to be inserted by the male connector, a locking member for locking the male connector, projected from the end of the casing, and female side connection terminals, each to be fitted to a terminal retaining section of the casing so that the leading end thereof is exposed in the insertion hole. Since the conductive wire of the cable connected to the male connector defines the connection terminal of the male connector, the small-sized multi-terminal type male connector is realized. The female connector to be mated thereto also can be miniaturized.

15 Claims, 14 Drawing Sheets

SMALL SIZE MALE MULTI-CONTACT CONNECTOR AND SMALL SIZE FEMALE MULTI-CONTACT CONNECTOR

BACKGROUND OF THE INVENTION

1. Field of the Invention

The present invention relates to connectors for connecting electrical signal lines including a power source line or an earth line and, particularly, to a small size male multi-contact connector and a small size female multi-contact connector (hereinafter small-sized multi-terminal type male and female connectors).

2. Description of the Related Art

A circular connector and a box-shaped connector of a rectangular shape have been popularly used in the prior art. The circular connector has, in a central area of a circular shell, a plurality of projected connector pins, a periphery of which is covered with resin or metal. There is a type of circular connector, wherein a lock member of a complicated structure is arranged around each of female and male connectors for locking the same when both the female and male connectors are coupled with each other.

On the other hand, various products of the box-shaped connector have been marketed, which are useful for being mounted onto a circuit board. For example, the box-shaped connectors are widely used as a connector for coupling a peripheral equipment, such as a hard disk drive, a cartridge magnetic tape drive, an optical disk drive or a printer, to a personal computer via a cable. The box-shaped connector usually has about 50 pins. Some of such connectors have no locking means but others include a high density type shield connector wherein female and male connectors are coupled with each other by screws and a ribbon type shield connector having a ribbon-like locking mechanism.

However, since the individual terminals in the circular connector are covered with resin or encircled with a metallic shell, a size of the connector becomes comparatively larger relative to the number of terminals. Also, the connector of a type wherein the female and male connectors are locked together necessarily has a complicated structure including a hook member and a catcher member arranged around the respective connectors.

However, the box-shaped connector has a considerably large size because it is laterally elongated and has a number of pins. Especially, one having a locking mechanism is complicated in structure resulting in the rise of manufacturing cost, and necessarily becomes much larger because of the addition of the locking mechanism. Accordingly, the box-shaped connector is suitable when there is a sufficient space for accommodating the same, but is unsuitable when the connector is used in a limited space, such as when the connector is coupled through a hole having a predetermined size.

For example, if one wishes to connect an outdoor video camera for a door phone, which has recently become popular, with an indoor monitor, it is difficult to do so by using the box-shaped connector, because the size of the connector is too large to install the video camera while using a conventional type peep hole in the door. Thus, it is necessary to enlarge the peep hole in the door when the box-shaped connector is used. Since the conventional circular connector becomes also larger as the number of pins increases, there is the same problem as that of the box-shaped connector.

SUMMARY OF THE INVENTION

An object of the present invention is to provide small-sized multi-terminal type male and female connectors, having a number of connection terminals while minimizing the outer size thereof. Also, another object of the present invention is to provide small-sized multi-terminal type male and female connectors with a locking mechanism capable of easily locking both the connectors when coupling the same with each other.

The small-sized multi-terminal male connector according to the present invention includes cables, each comprising a conductive wire covered with a coating layer; a cable-supporting member, a conductive-wire guide member having a holding section for holding the folded conductive wire so that a male side connection terminal is formed by folding the conductive wire on the holding section, and a core member, thereby decreasing the size of the male connector.

A predetermined number of cables corresponding to that of a connection terminals of a female connector are prepared, by removing a predetermined length of the coating layer from a leading end of each the cable to expose the conductive wire. The cable-supporting member is formed as a cylindrical member, through which pass the cables. The conductive-wire guide member is formed as a cylindrical member, an outer wall of which is sectioned by a plurality of partitions to define holding sections between every adjacent two partitions, so that the conductive wire of the cable passing through the cable-supporting member is folded on the holding section from outer side to inner side thereof to form a male side connection terminal. The core member has a flange at one end so that, when the other end of the core member is inserted into the inner space of the conductive-wire guide member and the inner space of the cable-supporting member, the conductive wire folded on the holding section is nipped between the flanged core member and the holding section, and the cable passing through the cable-supporting member is held between the inner surface of the cable-supporting member and the outer surface of the core member.

The partition preferably extends radially relative to a center of the cylindrical conductive-wire guide member, so that more cables can be connected to the male connector by folding the conductive wire on the holding section defined between the adjacent partitions.

Preferably, a key groove is provided in the core member in the longitudinal direction, and a positioning key is provided at a position corresponding to that of the key groove in the insertion holes of the conductive-wire guide member and the cable-supporting member, to enhance the positioning of the members when the male connector is assembled.

If a locking mechanism is provided between the key groove and the positioning key provided in the cable-supporting member, the coupling between the respective members constituting the male connector becomes rigid.

The small-sized multi-terminal type female connector according to the present invention includes a casing having an insertion hole into which the small-sized multi-terminal type male connector is inserted, female side connection terminals to be electrically connected to the male side connection terminals in the male connector inserted into the insertion hole, and terminal retaining sections provided in part of the casing for retaining the female side connection terminals, thereby decreasing the size of the female connector. A locking member is preferably provided at an end of the casing closer to the male connector for locking the male side connection terminal, to firmly couple the casing with the male connector.

In such a case, the female side connection terminal is preferably formed of a resilient member comprising a press-fit section to be press-fitted to an insertion groove, a contact section extending from the press-fit section and projecting into the insertion groove in a bending state, and an external terminal.

The casing may have a bottom wall in which are provided resilient mounting legs for mounting the female connector to a printed circuit board.

It is possible to realize a small-sized multi-terminal type connector assembly by combining these small-sized multi-terminal type male and female connectors.

BRIEF DESCRIPTION OF THE DRAWINGS

The present invention will be described in more detail below with reference to the attached drawings; wherein

in FIG. 5A, cables pass through a cable-supporting member; in FIG. 5B, a conductive wire of the cable is folded on a holding section of a conductive-wire guide member; in FIG. 5C, a core member is mounted to the conductive-wire guide member carrying the conductive wire; and in FIG. 5D, the cable-supporting member is fitted around the core member mounted to the conductive-wire guide member;

DESCRIPTION OF THE PREFERRED EMBODIMENTS

Before explaining the preferred embodiments of the present invention, prior art connectors will be described with reference to FIGS. 1 and 2.

Figure 1:
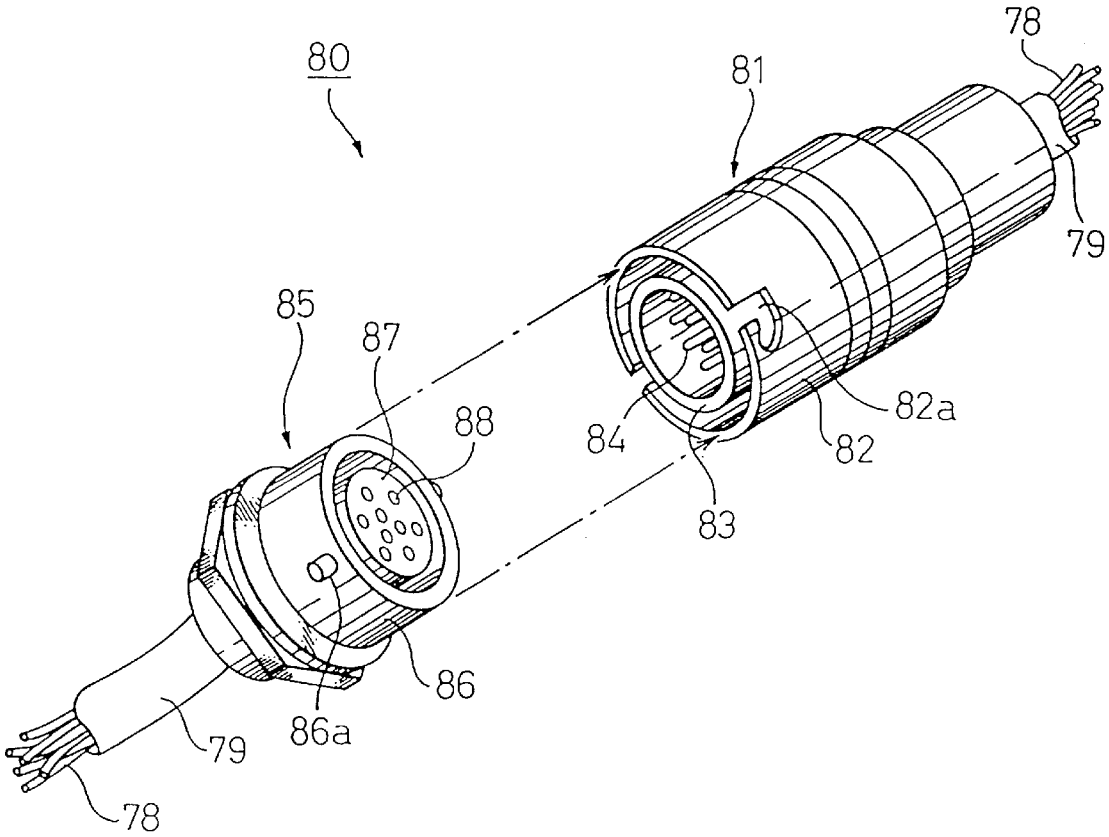
Fig.1 PRIOR ART
FIG. 1 is a perspective view of a conventional circular connector.

FIG. 1 shows a structure of the conventional circular connector assembly 80. The circular connector assembly 80 consists of a plug 81 forming a male connector, and a receptacle 85 forming a female connector. The plug 81 is of a double tube structure having an outer shell 82 and an inner shell 83 and the outer shell 82 is around the inner shell 83. A locking groove 82*a* is provided on the outer surface of the outer shell 82, and a plurality of pins 84 forming connection terminals project in the inner space of the inner shell 83. Each of the pins 84 is connected to each of signal lines 78 composing a cable 79 which is connected to the plug 81.

On the other hand, the receptacle 85 has a shell 86 to be inserted into a space between the outer shell 82 and the inner shell 83, and an inner body 87 provided with holes 88 to be inserted by the pins 84 of the plug 81. Locking projections 86a are provided on the outer surface of the shell 86, at positions corresponding to the locking grooves 82*a* in the outer shell 82 of the plug 81. The locking projection 86*a* is inserted into the locking groove 82*a* of the plug 81 when the plug 81 is coupled to the receptacle 85 to lock the plug 81 to the receptacle 86. Also, the individual hole 88 has an electrode therein, and each electrode is connected to each signal line 78 comprising a cable 79.

However, since the pin 84 is encircled with the inner shell 83 and the outer shell 82, both made of a metal in the circular connector 80, as shown in FIG. 1, a size of the connector is larger relative to the number of the pins 84, which hinders the miniaturization of the connector.

Figure 2:
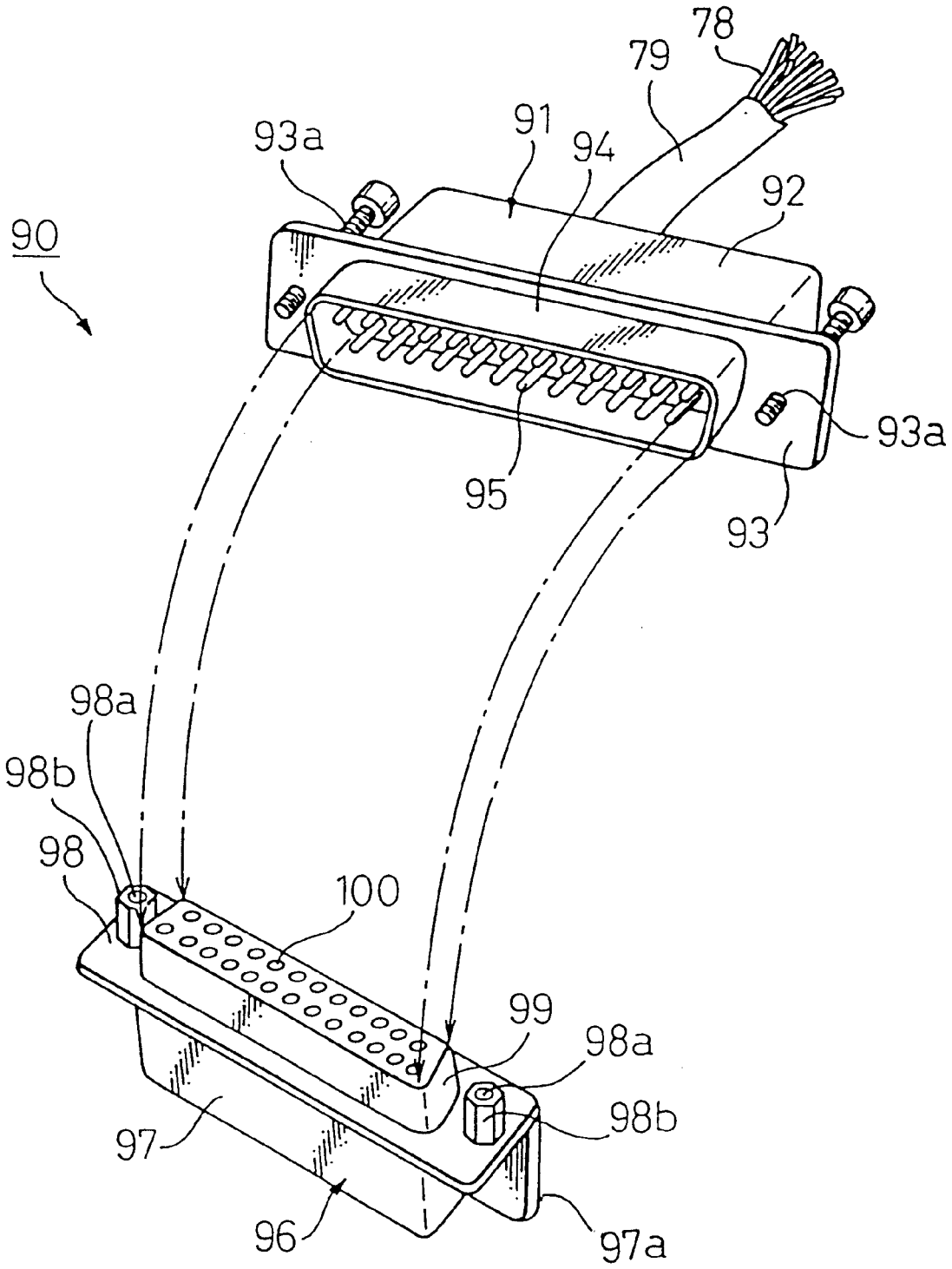
Fig. 2 PRIOR ART
FIG. 2 is a perspective view of a conventional box-shaped connector.

FIG. 2 shows the structure of a conventional box-shaped connector assembly 90 widely used for connecting a cable 79 used for the connection of the personal computer with a peripheral equipment such as a hard disk device, a cartridge magnetic tape device, an optical disk device or a printer. The box-shaped connector assembly 90 consists of a plug 91 forming a male connector and a socket 96 for forming a female connector.

The plug 91 has a flange 93 and a shell 94 both made of a metal at a front end of a body 92 to which the cable 79 is connected. In the inner space of the shell 94, a plurality of pins 95 are provided as connection terminals. Each of the pins 95 is connected to each of signal lines 78 forming a cable 79 to be connected to the body 92. Also, the flange 93 has screws 93*a* located on opposite sides of the body 92, respectively, for locking the plug 91 to the socket 96.

On the other hand, the socket 96 has a metallic flange 98 and an engagement projection 99 made of synthetic resin at a front end of a body 97. The engagement projection 99 has a plurality of holes 100 at positions corresponding to the pins 95 in the plug 91. Each of the holes 100 has a terminal to be connected to the pin 95. In the illustrated embodiment, the body 97 is provided with a mounting plate 97*a*, by which the socket 96 is mounted to a circuit board not shown. In such a case, the connection terminals in the holes 100 are connected to circuit patterns on the circuit board. Also, the flange 98 extending to the opposite sides of the engagement projection 99 has bosses 98*b* with threaded holes 98*a* to be screw-engaged with the screws 93*a* of the plug 91.

While the illustrated embodiment of the box-shaped connector assembly 90 has 25 pins, more pins, up to 50, may be provided in the box-shaped connector. Further, there is a high density type shield connector wherein female and male connectors are coupled with each other by screws, or a ribbon type shield connector having a ribbon-like locking mechanism. Accordingly, the size of the box-shaped connector becomes large since it is long and a large number of pins are provided. Also, as described with reference to FIG. 2, the connector having the locking mechanism is complicated in structure resulting in the rise of manufacturing cost, and necessarily becomes much larger because of the addition of the locking mechanism. Accordingly, the box-shaped connector is suitable when there is a sufficient space for accommodating the same, but is unsuitable when the connector is used in a limited space; for example, when the connector is coupled through a hole having a predetermined size.

The small-sized multi-terminal type male and female connectors according to the present invention have a structure for solving such problems in the conventional multi-terminal connector.

Figure 3:
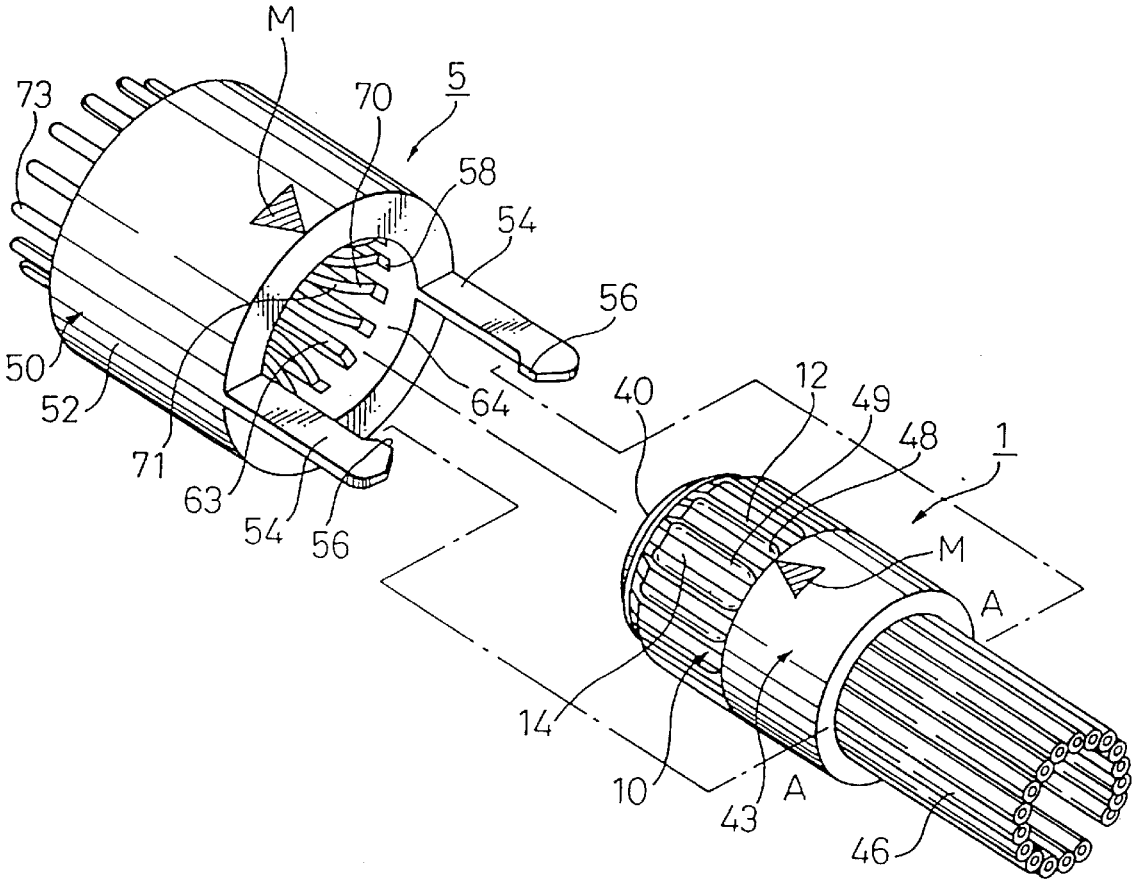
FIG. 3 is a perspective view showing an overall structure of a first embodiment of small-sized multi-terminal type male and female connectors according to the present invention.

FIG. 3 shows an overall structure of a first embodiment of a small-sized multi-terminal type male connector 1 (hereinafter referred to as a male connector) and a small-sized multi-terminal type female connector 5 (hereinafter referred to as a female connector). The male connector 1 includes a conductive-wire guide member 10, a core member 40 and a cable-supporting member 43, and is connected to cables 46. The conductive-wire guide member 10 has a plurality of male side grooves 12 and partitions 14, so that part of a conductive wire 48 of the cable 46 folded on a holding section (not shown) forms a male side connection terminal 49. A positioning mark M is provided on the outer surface of the cable-supporting member 43. The positioning mark M may be printed or formed integrally with the cable-supporting member 43 when the latter is molded.

On the other hand, the female connector 5 includes a female side casing 50 having a tubular section 52, an insertion hole 64 for receiving the male connector 1, and a bottom section not shown. From one end of the tubular section 52, two arms 54 extend, each having a hook 56 for locking the male connector 1. Female side grooves 58 are provided in the insertion hole 64, for receiving female side connection terminals 70, respectively. Part of the female side connection terminal forms a contact section 71 for electrically connecting with the connection terminal 49 of the male connector 1. One end of the female side connection terminal 70 extends toward a back side of the tubular section 52 to form an external terminal section 73. Positioning ribs 63 are provided in the insertion hole 63. The positioning rib 63 extends parallel to the female side groove 58. A positioning mark M is provided on the outer surface of the tubular section 52, for positioning the female connector 5 to the male connector 1.

Figure 4:
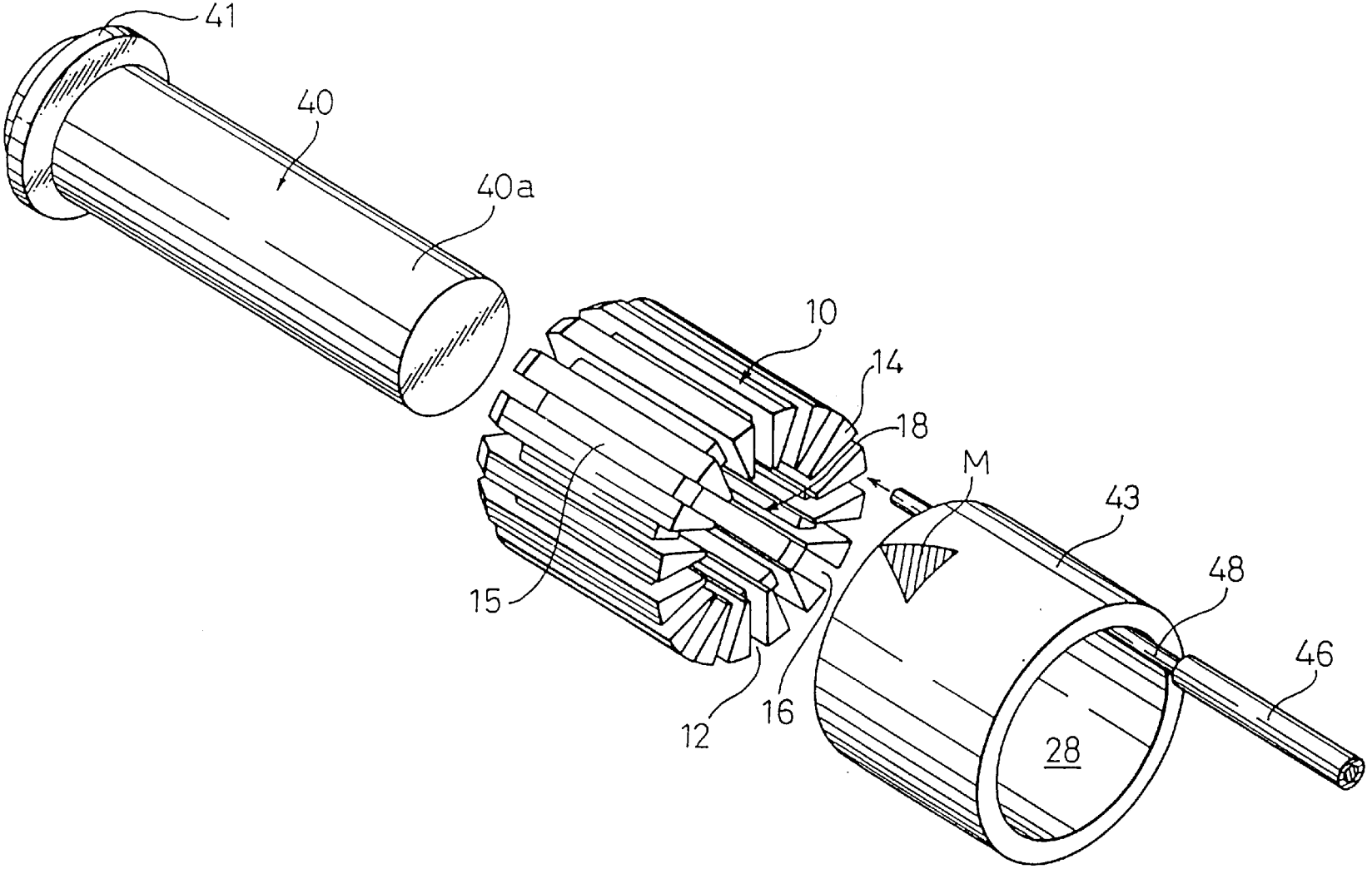
FIG. 4 is an exploded perspective view of the male connector shown in FIG. 3.

FIG. 4 is an exploded view of the male connector 1, shown in FIG. 3, consisting of the conductive-wire guide member 10, the core member 40, the cable-supporting member 43 and the cable 46.

The conductive-wire guide member 10 is a generally cylindrical member made of an insulating material, having an inner space 18. The partitions 14 are radially arranged outside the inner space 18. The male side groove 12 defined between the adjacent two partitions 14 has a constant width both in the longitudinal direction and the diametrical direction, and extends parallel to an axis of the conductive-wire guide member 10. A depth of the male side groove 12 is also constant, and the holding section 15 is defined by the bottom wall of the groove 12. The width of the male side groove 12 is selected to be capable of receiving the conductive wire 48 in a leading end of the cable 46 from which is removed a cover layer.

The core member 40 is a cylindrical member made of an insulating material, consisting of a main body 40*a* and a flange 41 at one end thereof. A diameter of the main body 40*a* is the same as an inner diameter of the inner space 18 of the conductive-wire guide member 10. A length of the main body 40*a* is the same as or nearly equal to a total length of the conductive-wire guide member 10 and the cable-supporting member 43.

The cable-supporting member 43 is a cylindrical member made of an insulating material, having an inner space 28, and in this embodiment, has an outer diameter substantially the same as that of the conductive-wire guide member 10, which, however, may be larger or smaller than the latter. A positioning mark M is provided on the outer surface of the cable-supporting member 43 at a position closer to the conductive-wire guide member 10. A diameter of the inner space 28 of the cable-supporting member 43 is selected to be slightly smaller than a diameter of the main body 40*a* of the core member 40 plus twice a diameter of the cable 46, so that the cover of the cable 46 is nipped and secured between the outer surface of the main body 40*a* of the core member 40 and the inner surface of the cable-supporting member 43 when the core member 40 is inserted into the inner space 28 while the cables 46 are held on the inner surface of the cable-supporting member 43.

Resinous materials such as ABS (acrylonitrilbutadiene-styrene), vinyl chloride, PS (polystyrene), PC (polycarbonate) or CFRP (carbon fiber reinforced plastic) may be used for molding the core member 40, the conductive-wire guide member 10 and the cable-supporting member 43 constituting part of the male connector 1.

Figure 5A:
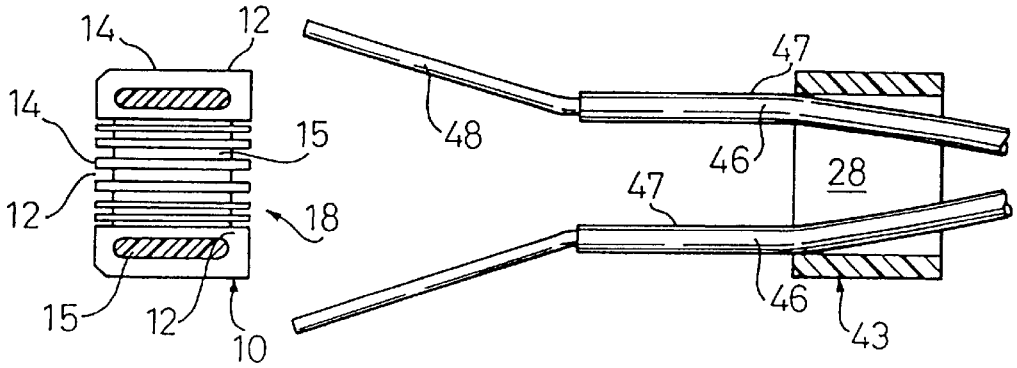
FIG. 5A to FIG. 5D illustrate the steps of assembling the male connector shown in FIG. 4.
Figure 5B:
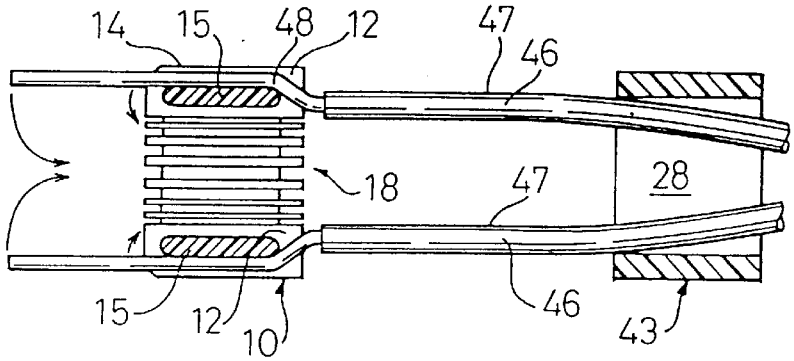
Figure 5C:
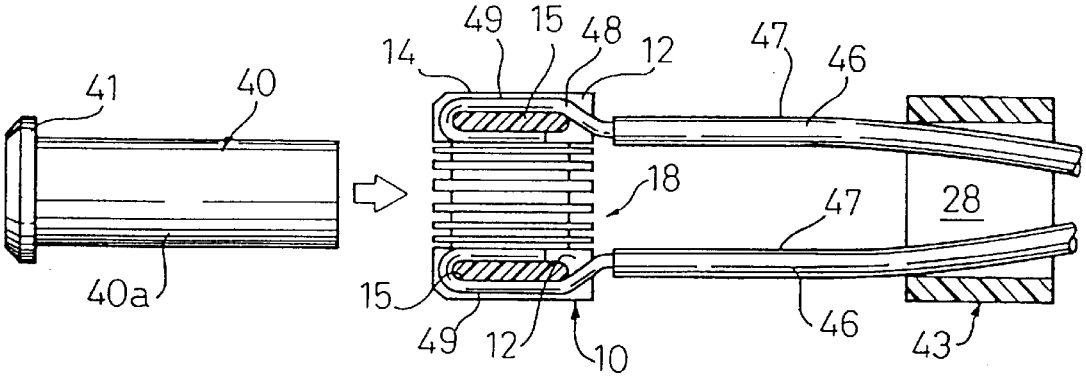

FIGS. 5A to 5C show the steps for assembling the male connector 1 in FIG. 3. When manufacturing the male connector 1, the cables 46 of the number identical to that of terminals of the male connector 1 initially pass through the cable-supporting member 43 as shown in FIG. 5A. In this regard, a predetermined length of the cover layer 47 of the leading end of the cable 46 has preliminarily been removed. The cable-supporting member 43 through which the cables 46 are inserted is shifted away from the leading end of the cables 46 for the purpose of enhancing the succeeding operation. The cable 46 preferably has a single conductive wire 48, but may have a twisted conductive wire. In the latter case, after removing the cover layer 47, the twisted conductive wire 48 is bundled to a single wire with a solder. If the twisted conductive wire 48 is partially plated with nickel or gold, the conductivity of the connecting section is further improved.

FIG. 5B shows how to fold the conductive wire 48 passing through the cable-supporting member 43 around the holding section 15 of the conductive-wire guide member 10. The conductive wire 48 is fitted into the male side groove 12 on the outer surface of the conductive-wire guide member 10, and folded on the holding section 15 as shown by arrows.

Then, as shown in FIG. 5C, the main body 40*a* of the core member 40 is fitted into the inner space 18 of the conductive-wire guide member 10 until the flange 41 abuts to the end surface of the conductive-wire guide member 10.

Figure 5D:
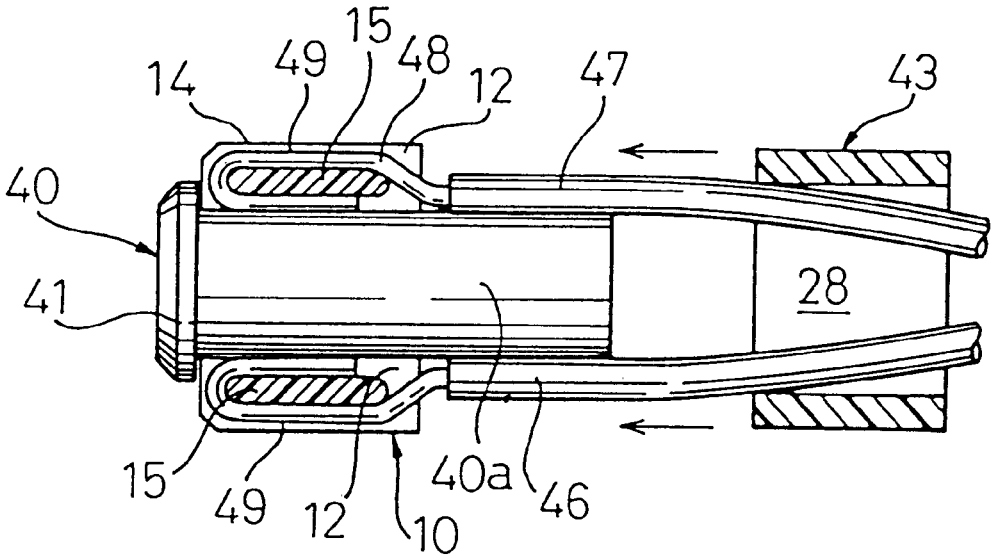

After the main body 40*a* of the core member 40 has been fitted into the conductive-wire guide member 10, the cable 46 are uniformly arranged on the main body 40*a* of the core member 40, as shown in FIG. 5D. Then, the cable-supporting member 43 is displaced toward the conductive-wire guide member 10, until an end of the cable-supporting member 43 abuts to the end surface of the conductive-wire guide member 10, and fitted onto the main body 40*a* of the core member 40 while compressing the cover layers 47 of the cables 46. In a state wherein the cable-supporting member 43 is positioned adjacent to the conductive-wire guide member 10, a front end of the main body 40*a* of the core member 40 is located at a position in the vicinity of the end A—A (see FIG. 6A) of the cable-supporting member 43.

As described above, the cables 46 are nipped between the cable-supporting member 43 and the core member 40. A force for resisting an external force acting in the direction for pulling out the cables 46 from the male connector 1 is obtainable by the grip of the cable between the cable-supporting member 43 and the core member 40 and the folding of the conductive wire 48 on the holding section 15. Accordingly, even if the cables 46 are pulled during the detachment of the male connector 1 from the female connector 5, there is no problem wherein the cables 46 only slip off from the conductive-wire guide member 10 and the cable-supporting member 43.

In this regard, it is not necessary to fill all the holding sections 15 of the conductive-wire guide member 10 with the conductive wires 40, but some of them may be vacant if required.

Figure 6A:
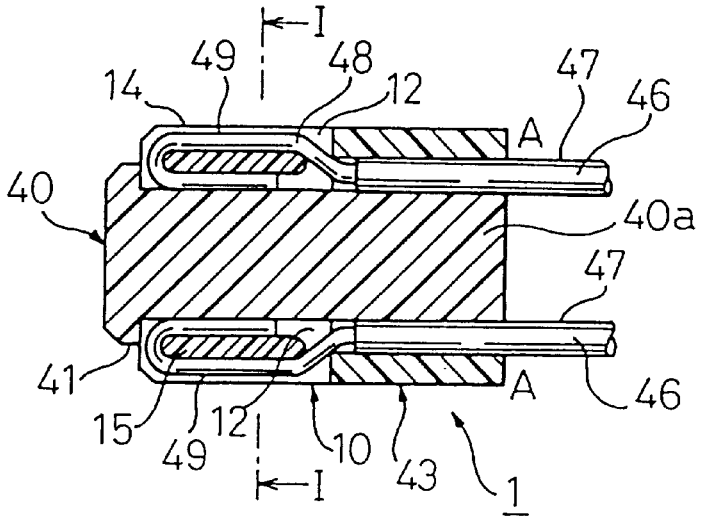
FIG. 6A is a sectional view of the male connector according to the first embodiment.
Figure 6B:
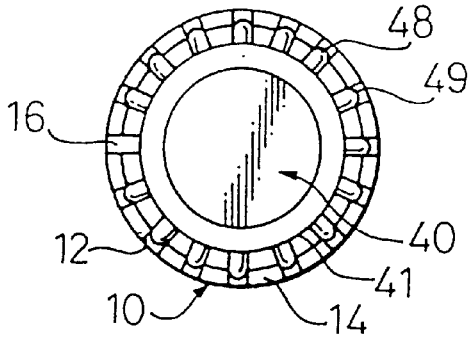
FIG. 6B is a front view of the male connector shown in FIG. 6A as seen from a core member side.
Figure 6C:
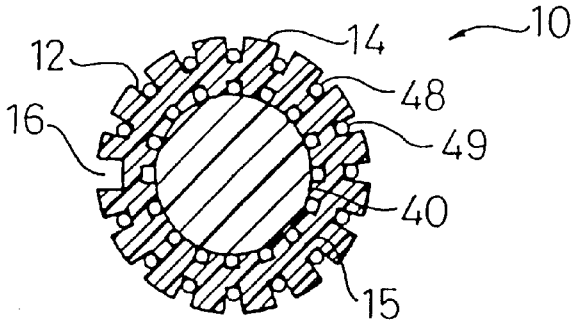
FIG. 6C is a cross-sectional view taken along line I—I in FIG. 6A.

FIG. 6A shows the male connector 1 assembled in accordance with the steps shown in FIGS. 5A to 5D. FIG. 6B is a view of the male connector 1 as seen from a flange 41 side of the core member 40, and FIG. 6C is a cross-sectional view taken along line I—I in FIG. 6A.

As is apparent from these drawings, in a state wherein the main body 40*a* of the core member 40 is fitted into the inner space 18 of the conductive-wire guide member 10 and the inner space 28 of the cable-supporting member 43, the leading end of the conductive wire 48 folded on the holding section 15 is nipped between the outer surface of the main body 40*a* of the core member 40 and the holding section 15, while the cover layer 47 of the cable 46 is nipped between the outer surface of the main body 40*a* of the core member 40 and the inner surface of the cable-supporting member 43. In such a state, part of the conductive wire 48 exposed from the holding section 15 forms the male side connection terminal 49 of the male connector 1.

Figure 7A:
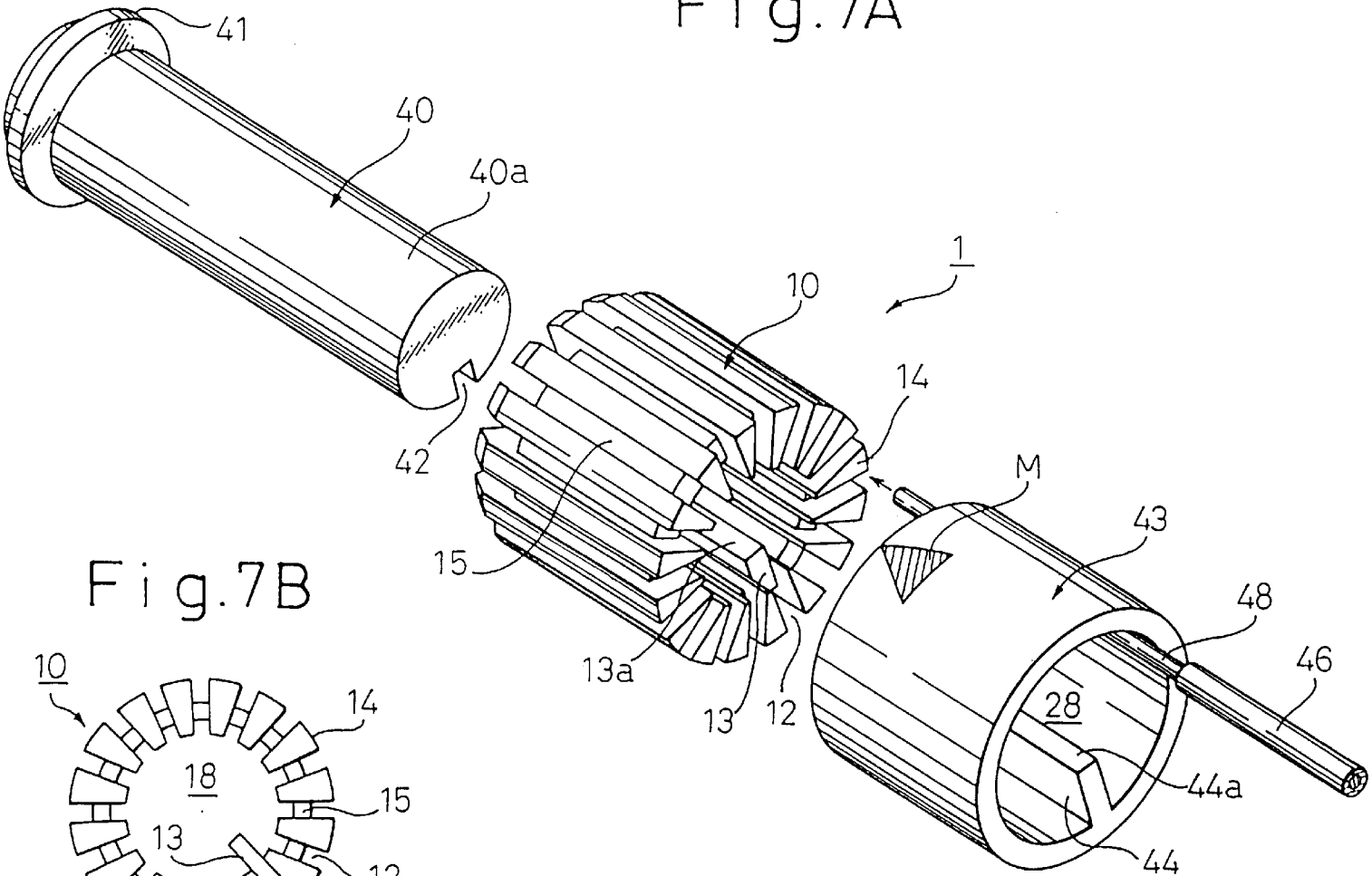
FIG. 7A is an exploded perspective view of a second embodiment of the small-sized male connector according to the present invention.

FIG. 7A shows a constitution of a second embodiment of the small-sized multi-terminal type male connector 1 according to the present invention. In the male connector 1 of the second embodiment, a positioning key 13 projects in the inner space 18 of the conductive-wire guide member 10 parallel to the axial direction thereof, and another positioning key 44 projects in the inner space 28 of the cable-supporting member 43 parallel to the axial direction thereof. On the other hand, a key groove 42 is provided in the main body 40*a* of the core member 40.

Figure 7B:
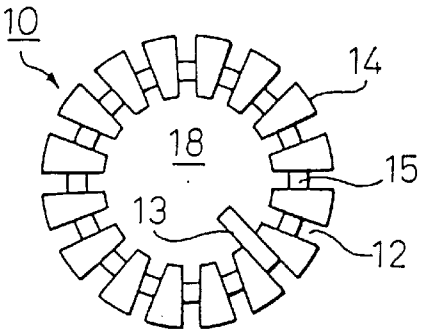
FIG. 7B is a front view of a conductive wire guide member shown in FIG. 7A.

The positioning key 13 in the inner space 18 of the conductive-wire guide member 10 is formed by extending one of the holding sections 15 inward of the inner space 18 as shown in FIG. 7B. The positioning key 44 in the inner space 28 of the cable-supporting member 43 has the same width as that of the positioning key 13. A height of the positioning key 44 is selected so that a top surface 44*a* thereof is flush with a top surface 13*a* of the positioning key 13 when the conductive-wire guide member 10 is located adjacent to the cable-supporting member 43. In addition, the key groove 42 provided in the main body 40*a* of the core member 40 has the same width as those of the positioning keys 13, 44, while a depth thereof is sufficient for accommodating the positioning keys 13, 44 when the main body 40*a* is fitted to the conductive-wire guide member 10 and the cable-supporting member 43.

Since the positioning keys 13, 44 are provided in the conductive-wire guide member 10 and the cable-supporting member 43 and the key groove 42 is provided in the main body 40*a* of the core member 40, as described above, the positioning of the conductive-wire guide member 10, the core member 40 and the cable-supporting member 43 are unitarily defined to enhance the assembly of the male connector 1.

Figure 8A:
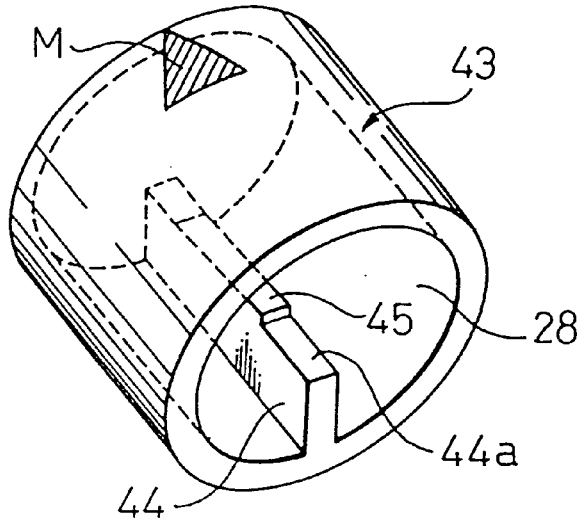
FIG. 8A is a perspective view of a cable-supporting member of a third embodiment of the small-sized multi-terminal type male connector according to the present invention.

FIG. 8A shows the structure of a cable-supporting member 43 in the small-sized multi-terminal type male connector 1 according to a third embodiment of the present invention. Similar to the second embodiment, a positioning key 13 projects in the inner space 18 of the conductive-wire guide member 10 parallel to the axial direction thereof, and another positioning key 44 projects in the inner space 28 of the cable-supporting member 43 parallel to the axial direction thereof. On the other hand, a key groove 42 is provided in the main body 40*a* of the core member 40. In addition to the structure of the second embodiment, according to the third embodiment, a locking projection 45 is provided on a top surface 44*a* of the positioning key 44 in the inner space 28 of the cable-supporting member 43, and also, as shown in FIG. 8B, a locking groove 39 is provided in the key groove 42 of the main body 40*a* of the core member 40 to be engageable with the locking projection 45.

Figure 8B:
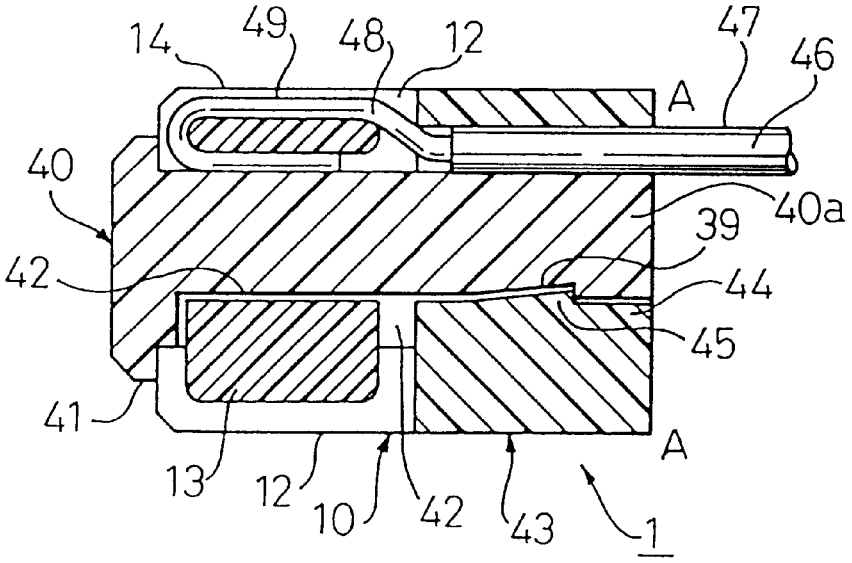
FIG. 8B is a sectional view of the third embodiment of the small-sized multi-terminal type male connector according to the present invention.

According to the third embodiment described above, when positioning keys 13, 44 of the conductive-wire guide member 10 and the cable-supporting member 43, to which the cables 46 are attached, are slidingly fitted to the key groove 42 of the main body 40*a* of the core member 40, as shown in FIG. 8B, the locking projection 45 of the positioning key 44 is locked by the locking groove 39 in the key groove 42 at an instant when the flange 41 abuts to a front end of the conductive-wire guide member 10. As a result, the core member 40 and the cable-supporting member 43 are firmly coupled with each other via the locking projection 45 and the locking groove 39. Also, the conductive-wire guide member 10 is firmly secured to the cable supporting member 43 by the flange 41 of the core member 40.

Figure 9A:
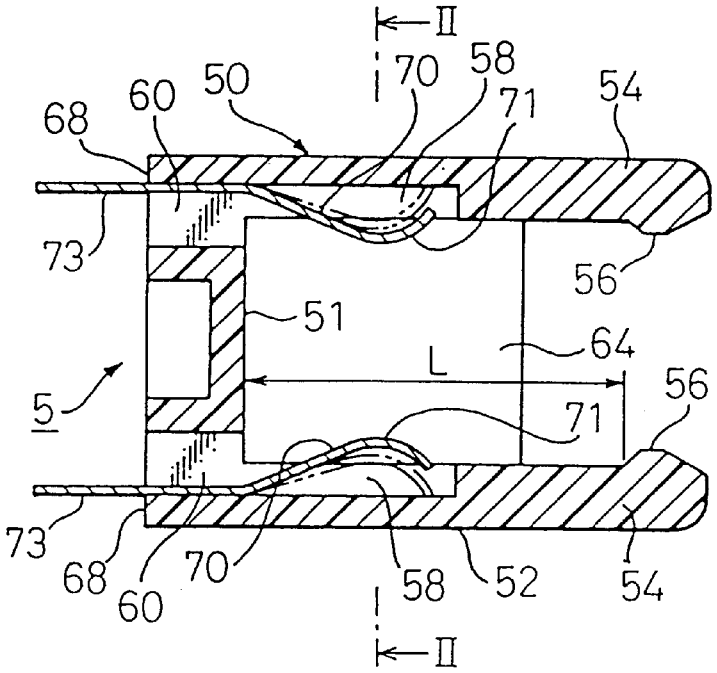
FIG. 9A is a sectional view of a first embodiment of a small-sized multi-terminal type female connector according to the present invention.
Figure 9B:
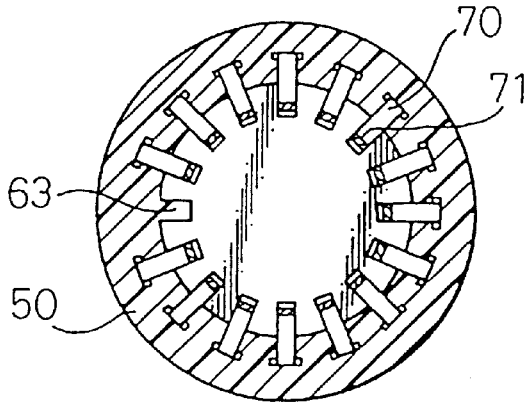
FIG. 9B is a cross-sectional view taken along line II—II in FIG. 9A.

FIG. 9A shows a first embodiment of the small-sized multi-terminal type female connector 5 according to the present invention. The casing 50 of the female connector 5 consists of a tubular section 52 having an insertion hole 64, a bottom wall 51 provided at one end of the tubular section 52, arms 54 provided at the other end of the tubular section 52, and a plurality of female side connection terminals 70. The tubular section 52 is cylindrical as shown in FIG. 9B. Resinous materials such as ABS, PS, PC or CFRP may be used for molding the female side casing 50, as in the case of the male connector 1 described before.

On the inner surface of the insertion hole 64, a plurality of female side grooves 58 are provided for retaining the female side connection terminals 70. As shown in FIG. 9B, a positioning projection 63 projects inside of the insertion hole 64 at a position corresponding to one of the grooves 58. This positioning projection 63 may be formed integral with the casing 50 when the same is molded. In this embodiment, a width and a height of the positioning projection 63 are selected to be smaller than those of the male side groove 12 formed in the conductor-wire guide member 10 of the male connector 1 to be fitted into the insertion hole 64 of the female connector 5, but may be any values provided the female side connection terminal 70 and the male side connection terminal 49 are smoothly coupled.

In addition, a hook 56 is provided for locking the male connector 1 at the leading end of the respective arm 54 projected from the one end of the tubular section 52. The arm 54 may be formed integral with the casing 50 when the same is molded. While two arms 54 are provided in this embodiment, the number of arms 54 may be one or more. Namely, the number of arms 54 is not limited. A length of the arm 54 is selected so that a distance L from the bottom wall 51 of the insertion hole 64 to the hook 54 is equal to a total length of the male connector 1 (i.e., a length from the end of the flange 41 of the core member 40 to the end of the cable-supporting member 43).

The female side groove 58 opening to the insertion hole 64 communicates with a through-hole 60 penetrating the bottom wall 51, and the female side connection terminal 70 is fitted into the through-hole 60 and the female side groove 58 from the bottom wall 68 side. The female side connection terminal 70 is made of a conductive metal having a high elasticity. A leading end of the female side connection terminal 70 bends and projects into the insertion hole 64 when fitted to the through-hole 60 to form a contact section 71. When the male connector 1 is inserted into the insertion hole 64, the contact section 71 moves from a position shown by a solid line to a position shown by a two-dot chain line, and is brought into contact with the male side connection terminal 49 of the male connector 1 (see FIG. 6A) at a predetermined pressure. A portion of the female side connection terminal 70 projected from the bottom wall 68 defines an external terminal 73 for externally outputting/inputting signals. The external terminal 73 is connected to a cable by a soldering, or to a circuit board by a soldering or a pin connector.

Figure 10A:
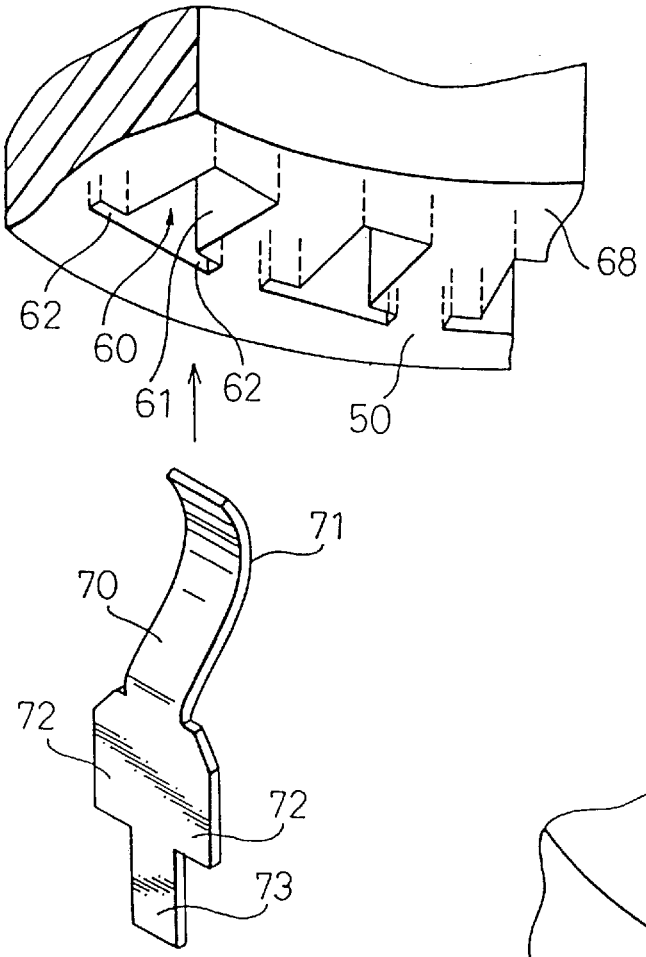
FIG. 10A is an enlarged perspective partial view illustrating how to attaching a female side connection terminal to the female connector according to the present invention.
Figure 10B:
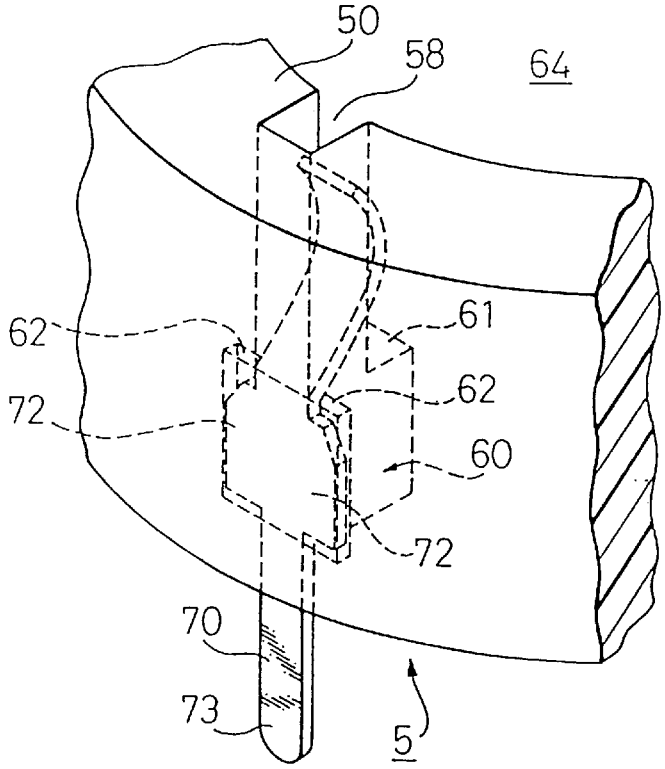
FIG. 10B is an enlarged perspective partial view illustrating a supporting state of the female side connection terminal in the female connector according to the present invention.

The steps for attaching the female side connection terminals 70 to the small-sized multi-terminal type female connector 5 of FIG, 9A will be described with reference to FIG. 10A. The female side connection terminal 70 consists of the contact section 71 for the electrical connection with the male side connection terminal 49, a press-fit section 72 provided at a base side of the contact section 71, and the external terminal 73 located at a leading end the press-fit section 72 to be projected from the female side casing 50 when the female side connection terminal 70 has been mounted to the female side casing 50. The through-hole 60 opening through the bottom wall 68 of the female side casing 50 consists of a contact-passing zone 61 and a terminal press-fit zone 62. The female side connection terminal 70 is inserted into the through-hole 60 so that the contact section 71 passes through the contact-passing zone 61, and the press-fit section 72 is press-fitted to the terminal press-fit zone 62. FIG. 10B illustrates a state wherein the female side connection terminal 70 has been fully fitted to the through-hole 60. In this state, the contact section 71 projects into the insertion hole 64, the press-fit section 72 is held in the terminal press-fit zone 62, and the external terminal 73 is exposed outside the female side casing 50. In such a manner, the female connector 5 incorporating the female side connection terminals 70 therein is obtained.

Figure 11:
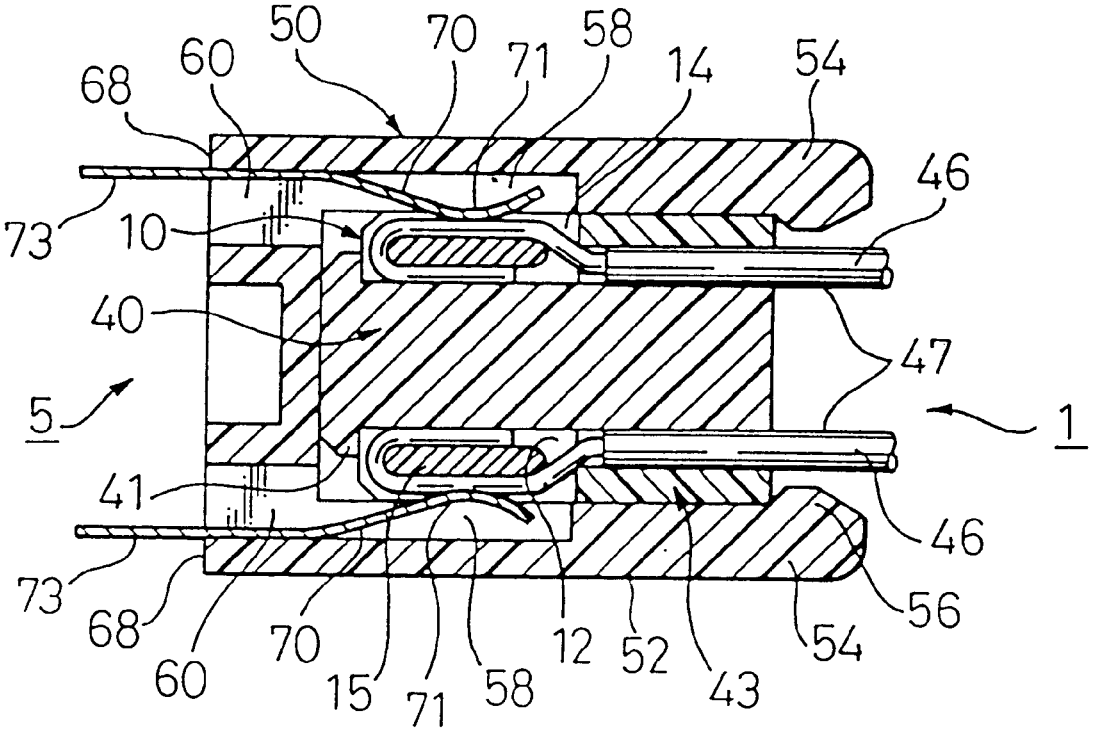
FIG. 11 is a sectional view of the assembly of the small-sized multi-terminal type male connector of the first embodiment with the small-sized multi-terminal type female connector of the first embodiment.

FIG. 11 illustrates a state wherein the small-sized multi-terminal type male connector 1 according to the first embodiment of the present invention is connected with the small-sized multi-terminal type female connector 5 according to the first embodiment of the present invention. As shown in FIG. 3, the connection between the male connector 1 and the female connector 5 is carried out by inserting the conductive-wire guide member 10 of the male connector 1 into the insertion hole 64 of the female connector 5. At this time, care should be taken so that a groove 16 of the male connector 1 having no conductive wire 48 therein (which groove is not visible in FIG. 3 but is shown in FIG. 6B) coincides with the positioning projection 63 of the female connector 5. That is, when the male connector 1 and the female connector 5 are coupled together, the groove 16 of the male connector 1 is positioned to the positioning projection 63 of the female connector 5 by aligning the positioning marks M, M provided on the outer peripheries of the male connector 1 and the female connector 5, respectively, with each other.

When the male connector 1 is inserted into the female connector 5 to predetermined depth, the hook 56 of the arm section 54 of the female connector 5 is locked to the end A—A of the cable-supporting member 43 of the male connector 1 (see FIG. 3). As a result, the male connector 1 is prevented from disengaging from the female connector 5 even though a small external force is applied thereto, whereby the reliability of the connector is improved.

Figure 12A:
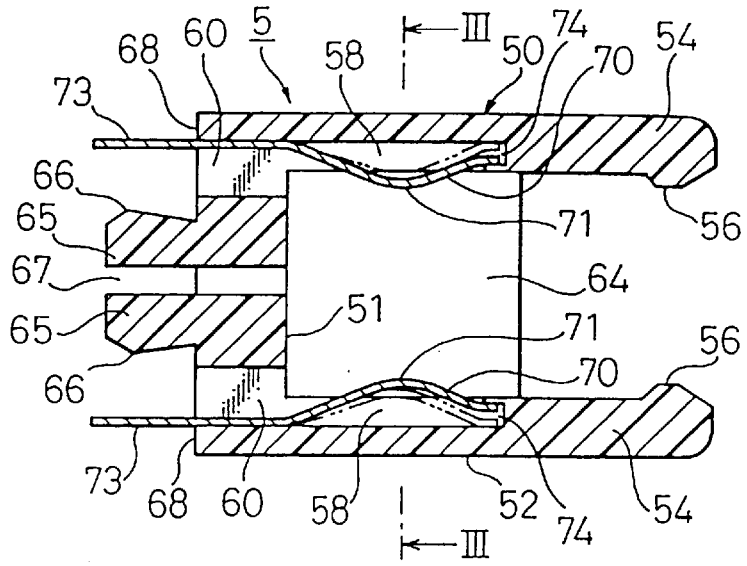
FIG. 12A is a sectional view of a second embodiment of the small-sized multi-terminal type female connector according to the present invention.
Figure 12B:
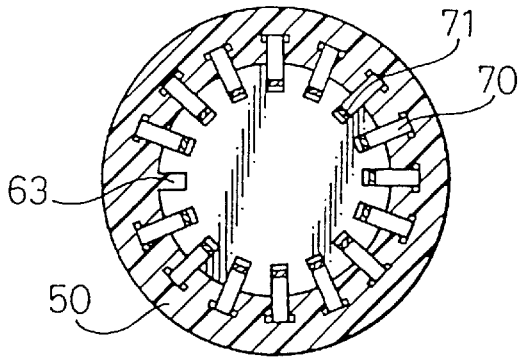
FIG. 12B is a cross-sectional view taken along line III—III in FIG. 12A.

FIG. 12A illustrates a second embodiment of the small-sized multi-terminal type female connector 5 according to the present invention, and FIG. 12B is a cross-sectional view thereof taken along line III—III in FIG. 12A. The difference of the female connector 5 according to the second embodiment from that of the first embodiment solely resides in that a mounting leg 65 is provided in the bottom wall 68 of the female side casing 50, for mounting the female connector 5 to a structural body such as a printed circuit board, and the leading end of the female side connection terminal 70 is received in an engagement recess 74 provided in the female side groove 58.

The engagement recess 74 has an extended wall for preventing the leading end of the contact section 71 from projecting into the insertion hole 64. According to the extended wall, the leading end of the contact section 71 is secured in the female side groove 58. By the engagement recess 74, the accidental bending of the leading end of the contact section 71 due to the collision with the male connector 1 can be avoided, even if an unexpected external force is applied to the female connector 5.

A dual taper 66 is formed in the mounting leg 65, so that the mounting leg 65 is shaped to once thicken from a base end to a tip end and then thin to the tip end. According to this thinning of the tip end of the mounting leg 65, the operation for mounting the mounting leg 65 to the structural body is enhanced. Also, a notch 67 of a predetermined width is formed in the mounting leg 65 in the longitudinal direction thereof.

Figure 12C:
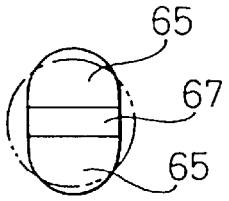
FIG. 12C is an illustration of the relationship between a mounting leg of FIG. 12A and a mounting hole therefor.

FIG. 12C is the illustration of the mounting leg 65 as seen from the tip end thereof. The mounting leg 65 has a generally oval-shaped cross-section with the notch 67 in the middle thereof. The notch 67 serves to impart the leg 65 with a high elasticity. The mounting leg 65 thus structured is integrally molded with the female side casing 50, and is fitted into a hole of a plate member such as a printed circuit board while reducing the width of the notch 67, to secure the female connector 5 on the plate member. In FIG. 12C, a size of the hole is illustrated by a two-dot chain line relative to the thickness of the mounting leg 65.

Figure 13:
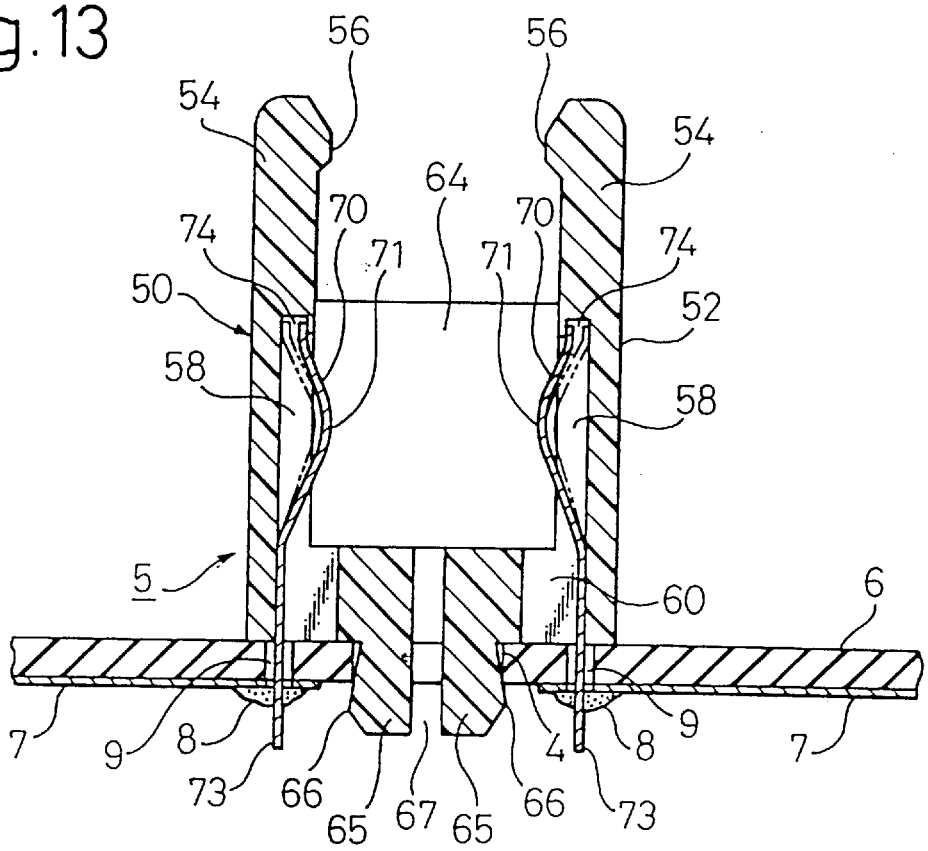
FIG. 13 is a sectional view of the second embodiment of the small-sized multi-terminal type female connector mounted to a circuit board.

FIG. 13 shows a state wherein the small-sized multi-terminal type female connector 5 according to the second embodiment of the present invention is mounted to the printed circuit board 6. At the same time when the mounting leg 65 is fitted to a hole 4 in the circuit board 6, the external terminals 73 of the female connector 5 are inserted into through-holes 9 in the circuit board 6. Circuit patterns 7 provided on the back side of the circuit board 6 are soldered to the external terminals 73 after the latter have been inserted into the through-holes 9. Since the female connector 5 is mounted to the circuit board 6 via the mounting leg 65, even if the external force is applied to the female connector 5, this external force is prevented from being transmitted to the external terminals 73 connected to the circuit patterns 7 of the circuit board 6, whereby the disconnection or deformation of the external connection is avoidable.

Figure 14:
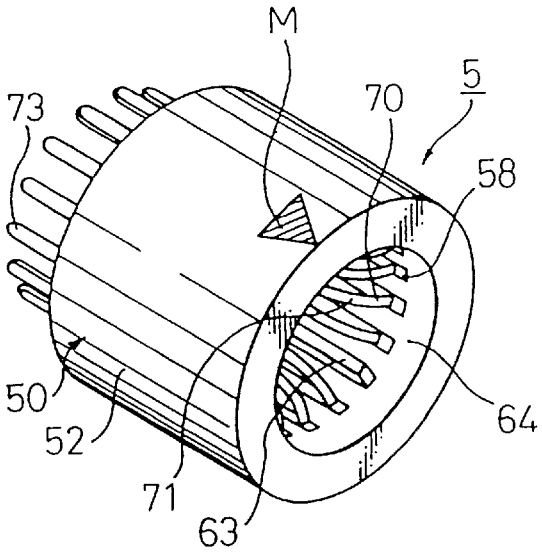
FIG. 14 is a perspective view of a third embodiment of the small-sized multi-terminal type female connector according to the present invention.

In the above description, the explanation was made on the embodiments wherein the female side casing 50 is formed by integrally molding the arms 54 having hooks 56 with the tubular section 52. However, in a female connector of a third embodiment, a tubular section 52 without arms 54 is used as a female side casing 50. FIG. 14 shows the structure of the female connector 5 of the third embodiment. In this case, to prevent the accidental disengagement of the male connector from the female connector, the contact pressure between the female side connection terminals 70 and the male side terminals 49 is increased.

Since the conductive wire 48 of the cable 46 constituting the lead for the connection to outside is used as the male side connection terminal 49, in the male connector 1 according to the present invention, separate terminal members are unnecessary, whereby the number of parts is reduced to lower the production cost. Since the holding section 15 is provided in the conductive-wire guide member 10 and the conductive wire 48 of the cable 46 is folded thereon to form the male side connection terminal 49, and also, the folded conductive wire 48 is held by the core member 40 pressed thereto, the male connector 1 of a small size and durable against a force for pulling out the cable 46 is obtainable.

While, since the female connector 5 is constituted by the female side connection terminals 70, each consisting of the contact section 71 having a high elasticity and the external terminal 73, and the female side casing 50, the connection thereof with the male connector 1 is achievable in a simple manner, whereby the production cost of the female connector 5 can be reduced to result in a low-cost connector assembly by the combination with the male connector 1.

Dimensions in the actual product are as follows: An outer diameter of the female side casing is 10.4 mm; an inner diameter of the insertion hole 64 is 8 mm; a length of the female side casing 50 except for the arm 54 is 10.9 mm; and a length of the female side casing 50 including the arm 54 is 17.5 mm. Thus the female connector 5 of a very small size was obtained.

The mounting leg 65 has a length of about 3 mm, and an outer diameter of a circular cross-section thereof including the opposite legs 65 is in a range from 4.3 mm to 5 mm. On the other hand, dimensions in the actual product of the male connector 1 are as follows: The cable-supporting member 43 has a total length of about 5 mm, an outer diameter of about 7.8 mm and an inner diameter of about 5.8 mm. Regarding the core member 40, the main body 40*a* has an outer diameter of about 4 mm, and the flange 41 has an outer diameter of about 5.7 mm and a thickness of about 0.85 mm. The conductive-wire guide member 10 has an outer diameter of about 7.8 mm, an inner diameter of about 4 mm and a length of about 4 mm. The holding section 15 has a thickness of about 0.7 mm. A single-core cable is used as the cable 46, having the cover layer 47 with an outer diameter of 1.2 mm.

What is claimed is:

1. A small-sized multi-terminal type male connector to be connected to a female connector having a plurality of connection terminals, comprising:

cables, each comprising a conductive wire wrapped with a cover layer, a cable-supporting member, a conductive-wire guide member having holding sections, and a core member, wherein each of the holding sections is for holding a conductive wire to form a male side connection terminal.

2. A small-sized multi-terminal type male connector as defined by claim 1, wherein a predetermined length of the cover layer is removed from a leading end of each of the cables to expose the conductive wires, and the number of the cables is equal to that of the connection terminals, the cable-supporting member is a cylindrical member for allowing the cables to pass therethrough, the conductive-wire guide member is a cylindrical member disposed adjacent to the cable-supporting member, and has a plurality of partitions defining one of the holding sections between each two of the plurality of partitions; the conductive wire of each cable passing through the cable-supporting member being folded around the holding section from outside to inside to form a male side connection terminal by the conductive wire thus folded, and the core member has a flange at one end, and supports the conductive wires folded around the holding sections between the core member and the holding sections by fitting the other end of the core member into inner spaces of the cylindrical conductive-wire guide member and the cylindrical cable-supporting member, and holds the cables passing through the cable-supporting member between the core member and an inner wall of the cable-supporting member.

3. A small-sized multi-terminal type male connector as defined by claim 2, wherein the partitions extend in a radial manner relative to a center axis of the cylindrical conductive-wire guide member, and the holding section defined between each two partitions is located at a position deeper by a diameter of a conductive wire from an outer periphery of the partition.

4. A small-sized multi-terminal type male connector as defined by claim 2, wherein a key groove is longitudinally provided in the core member, and a key fitted to the key groove is projected in the inner spaces of the conductive-wire guide member and the cable-supporting member.

5. A small-sized multi-terminal type male connector as defined by claim 4, wherein a locking mechanism is provided between the key groove in the core member and the key in the cable-supporting member.

6. A small-sized multi-terminal type female connector to be connected to a male connector having a plurality of connection terminals, comprising a casing having an insertion hole to be fitted to the male connector, female side connection terminals to be electrically connected to the male side connection terminals of the male connector inserted into the insertion hole, and a terminal-retaining section provided in part of the casing, for retaining the female side connection terminals.

7. A small-sized multi-terminal type female connector as defined by claim 6, wherein the female side connection terminal is formed of a member having a high elasticity, and comprises a press-fit section to be inserted into the terminal retaining section, a contact section extending from the press-fit section to be projected into the insertion hole in a bending state when inserted into the terminal retaining section, and an external terminal extending from the press-fit section in the direction opposite to the contact section.

8. A small-sized multi-terminal type female connector as defined by claim 7, wherein the leading end of the contact section is located in an engagement recess provided adjacent to the terminal retaining section, whereby the leading end of the contact section is prevented from projecting into the insertion hole.

9. A small-sized multi-terminal type female connector as defined by claim 6, further comprising a locking member projected from an end of the casing at which the insertion hole is opened, for locking the male connector inserted into the insertion hole.

10. A small-sized multi-terminal type female connector as defined by claim 9, wherein the female side connection terminal is formed of a member having a high elasticity, and comprises a press-fit section to be inserted into the terminal retaining section, a contact section extending from the press-fit section to be projected into the insertion hole in a bending state when inserted into the terminal retaining section, and an external terminal extending from the press-fit section in the direction opposite to the contact section.

11. A small-sized multi-terminal type female connector as defined by claim 10, wherein the leading end of the contact section is located in an engagement recess provided adjacent to the terminal retaining section, whereby the leading end of the contact section is prevented from projecting into the insertion hole.

12. A small-sized multi-terminal type female connector as defined by any one of claims 6 to 11, wherein a bottom wall is provided at one end of the casing opposite to the opening of the insertion hole, and a mounting leg having a high elasticity is provided in the bottom wall, for mounting the female connector onto a printed circuit board.

13. A small-sized multi-terminal type connector assembly comprising a small-sized multi-terminal type female connector having a connection hole, in the inner periphery of which are exposed a plurality of female side connection terminals, and a small-sized multi-terminal type male connector, in the outer periphery of which are exposed a plurality of male side connection terminals, wherein the small-sized multi-terminal type male connector comprises:

cables, each comprising a conductive wire wrapped with a cover layer, a cable-supporting member, a conductive-wire guide member, and a core member, wherein the conductive-wire guide member has holding sections, each used for holding the folded conductive wire to form a male side connection terminal, and the small-sized multi-terminal type female connector comprises a casing having an insertion hole to be fitted to the male connector, female side connection terminals to be electrically connected to the male side connection terminals of the male connector inserted into the insertion hole, and a terminal-retaining section provided in part of the casing, for retaining the female side connection terminals.

14. A small-sized multi-terminal type connector assembly as defined by claim 13, wherein, in the small-sized multi-terminal type male connector, the cable is prepared so that a predetermined length of the cover layer is removed from a leading end of the cable to expose the conductive wire, and the number of the cables is equal to or less than that of the connection terminals, the cable-supporting member is a cylindrical member for allowing the cables to pass therethrough, the conductive-wire guide member is a cylindrical member disposed adjacent to the cable-supporting member, and has a plurality of partitions defining holding sections between every adjacent two partitions; the conductive wire of the cable passing through the cable-supporting member being folded around the holding section from outside to inside to form the male side connection terminal by the conductive wire thus folded, and the core member has a flange at one end, and supports the conductive wire folded around the holding section between the core member and the holding section by fitting the other end of the core member into the inner spaces of the conductive-wire guide member and the cable-supporting member, and holds the cable passing through the cable-supporting member between the core member and the inner wall of the cable-supporting member.

15. A small-sized multi-terminal type connector assembly as defined by claim 13 or 14, wherein the small-sized multi-terminal type female connector further comprises a locking member projected from an end of the casing at which the insertion hole is opened, for locking the male connector inserted into the insertion hole.

* * * * *